US007481491B1

(12) United States Patent
Diamantis

(10) Patent No.: US 7,481,491 B1
(45) Date of Patent: Jan. 27, 2009

(54) REVERSIBLE CHAIR PAD

(76) Inventor: Erica Jane Diamantis, P.O. Box 157, Ryland, AL (US) 35767

( * ) Notice: Subject to any disclaimer, the term of this patent is extended or adjusted under 35 U.S.C. 154(b) by 100 days.

(21) Appl. No.: 11/261,216

(22) Filed: Oct. 28, 2005

Related U.S. Application Data

(60) Provisional application No. 60/624,711, filed on Nov. 4, 2004.

(51) Int. Cl.
*A47C 27/00* (2006.01)
*A47C 31/00* (2006.01)

(52) U.S. Cl. ..... 297/223; 297/228.12

(58) Field of Classification Search ..... 297/219.1, 297/223, 228.1, 228.12; 5/655.6, 652
See application file for complete search history.

(56) References Cited

U.S. PATENT DOCUMENTS 1,469,523 A * 10/1923 McGarvey ..... 5/490
3,109,474 A * 11/1963 Levi ..... 150/158
4,712,833 A * 12/1987 Swanson ..... 297/228.12
5,475,886 A * 12/1995 Mintz ..... 5/653
6,212,717 B1 * 4/2001 Cooper ..... 5/653
7,207,627 B2 * 4/2007 Jerome ..... 297/219.1

* cited by examiner

*Primary Examiner*—Milton Nelson, Jr.

(57) ABSTRACT

A reversible chair pad includes a cover comprising first and second fabrics forming respective first and second surfaces of the pad that are mutually attached at the pad perimeter, and where the first and second fabrics also form a two-ply skirt member extending from the pad perimeter. The perimeter of the skirt member is less than the pad perimeter and disposed to one side of the pad such that the pad displays only one of said first or second fabrics. The pad comprises anti-slip means secured to the skirt perimeter such that said anti-slip means is operable to contact a chair seat surface independent of pad display. The pad also includes a first set of securing ties for securing said pad to chair spindles when the pad is configured to display the first fabric attached to an edge of the pad perimeter intermediate the skirt member and the first surface. Also included is a second set of securing ties for securing the pad to chair spindles when the pad is configured to display the second fabric, the second set of ties attached intermediate said skirt member and said second surface to the same edge of said pad perimeter as that to which the first set of ties is attached.

16 Claims, 2 Drawing Sheets

REVERSIBLE CHAIR PAD

CLAIM OF PRIORITY

This application claims priority of Provisional Application No. 60/624,711 filed Nov. 4, 2004, which is incorporated herein by reference.

BACKGROUND

1. Field

The present invention relates generally to a chair gad, and particularly to a reversible chair pad, and more particularly to a reversible chair pad having an incorporated slip resistant material.

2. Description of the Problem and Related Art

Chair pads have long been used to soften the seats of wooden chairs. These pads are often assembled of a casing constructed from one fabric so that the pad is roughly the same on one side as it is on the other. However, home decor may be subject to changing whims, and an owner of such chairs may become tired of the look presented by such pads. One costly option is to purchase new pads.

Frugally minded people may not wish to purchase an entire new set of chair pads. With these people in mind, pads were developed having casings constructed of two types of material so that different looks may be presented according to the owner's desires. A shortcoming of simply making the casing from two materials is that the downward facing side may still be visible when viewing the pad from the side. It may be desirable, however, to give the appearance that the pad is not reversible, but a pad having casing of one material.

One attempt to provide a pad that addresses this shortcoming is described in U.S. Pat. No. 1,469,523 to McGarvey wherein a reversible pad is constructed such that a first side of the casing is of a first material and the opposing side is of varying material. McGarvey discloses the addition of a skirt member to enclose the sides and part of one surface when the pad is desired to display only the opposing side of the pad. The skirt is drawn tight around the pad and the hem thereof drawn toward the center of the pad through the use of a draw string in the hem. The skirt is attached to the casing near the periphery of the pad only on one side of the pad, the side opposite that which the skirt hides. When it is desired to display the other side, the skirt drawstring is loosed, and the skirt is drawn back to the side to which it is attached, and the pad is simply placed on the chair on top of the skirt. The skirt is made out of the same material as that of the side to which it is attached. This design suffers from a complex design and inefficient use of the skirt in addition to a complicated process for reversing the pad appearance.

A more rudimentary device for achieving pad reversibility is exemplified in U.S. Pat. No. 3,695,691 to Putnam where the casing is constructed of two fabrics, one fabric for the exterior of the casing, one for the interior. The casing is provided with a zipper so that converting the pad involves opening the zipper, removing the pad material, inverting the casing, reinserting the pad material into the casing, and closing the zipper again.

A further attempt to address reversibility is shown in U.S. Pat. No. 5,557,815 to Mintz for an article that can be converted from a chair cushion to a throw pillow. A cushion member is encased in two different fabrics on opposing sides. Attached to the periphery of the cushion are two flaps, disposed at opposing ends of the cushion, each flap attached to the cushion periphery along three edges with the unattached portion of each flap overlapping the other flap across the middle of the cushion. In the chair pad configuration, a pair of tie sets extends from the cushion casing to anchor the cushion to a spindle-backed chair or the like. In converting the cushion, the flaps are drawn back over the ends, with the tie sets tucked into the pocket of the flap disposed upon the side to which they are attached. The cushion is forced through the two flaps which are then drawn back across the opposing surface of the cushion such that they again overlap across the middle. The flaps are likewise constructed of the same two fabrics as those encasing the cushion, with like fabric of flaps and cushion casing being on the same relative plane so that a cushion encased in a single fabric is shown in either arrangement. This design arguably presents a better use of materials, but the inversion procedure is cumbersome, and stresses the seams of the flaps.

De Geus, U.S. Pat. No. 4,312,087 is directed to a reversible cushion made of two types of material forming a casing for a core. The two fabrics extend beyond the area of the core and are sewn together. The corners are reduced such that an aperture having a circumference less than that of the core is produced and &posed upon one side of the encased core. To reverse this pillow, the core is pushed through the collar which is flipped to the opposing side.

One problem common to the use of chair pads used on wooden furniture is that they tend to slip when a person seated upon such a pad shifts her weight. To prevent the pad from departing the seat, pad casings are provided with ties attached thereto which are tied around chair backs. For example, long known in the art is the use of pads with chairs having a back comprised of a plurality of spindles, where a pad typically includes two pairs of ties that tie to two of the spindles, securing the pad. This still does not prevent the pad from sliding upon the seat. This has also heretofore not been a technique for use in reversible chair pads to keep them secured to the chair on which they are used.

A design that attempts to address the problem of slipping is found in U.S. Pat. No. 5,906,878 to Horning et al. where a panel of material having a high coefficient of friction is placed between the seat and the pad. Another attempt is shown in U.S. Des. Pat. No. 360,794 to Morin for a pad incorporating a panel of high friction material. U.S. Pat. No. 5,896,603 and its child U.S. Pat. No. 6,212,717, both to Cooper disclose a pad having a bottom panel with a high coefficient of friction. Of course, none of these disclose a reversible pad.

In view of the limitations now present in the prior art, the present invention provides a new and useful Reversible Chair Pad which is simpler in construction, more universally usable and more versatile in operation than known articles of this kind.

SUMMARY

The present disclosure is directed to a pad which satisfies a need for an attractive yet variable presentation, along with the comfort and convenience of slip resistance. A reversible chair pad according to an embodiment of the present invention includes a cover comprising first and second fabrics forming respective first and second surfaces of the pad that are mutually attached at the pad perimeter, and where the first and second fabrics also form a two-ply skirt member extending from the pad perimeter. The perimeter of the skirt member is less than the pad perimeter and disposed to one side of the pad such that the pad displays only one of said first or second fabrics. The pad comprises anti-slip means secured to the skirt perimeter such that said anti-slip means is operable to contact a chair seat surface independent of ad display. The pad also includes a first set of securing ties for securing said ad to chair spindles when the pad is configured to display the first fabric attached to an edge of the pad perimeter intermediate the skirt member and the first surface. Also included is a second set of securing ties for securing the pad to chair spindles when the pad is configured to display the second fabric, the second set of ties attached intermediate said skirt member and said second surface to the same edge of said pad perimeter as that to which the first set of ties is attached.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

These and other embodiments of the present invention also become readily apparent to those skilled in the art from the following detailed description of the embodiments having reference to the attached figures, the invention not being limited to any particular embodiment(s) disclosed.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

Figure 1A:
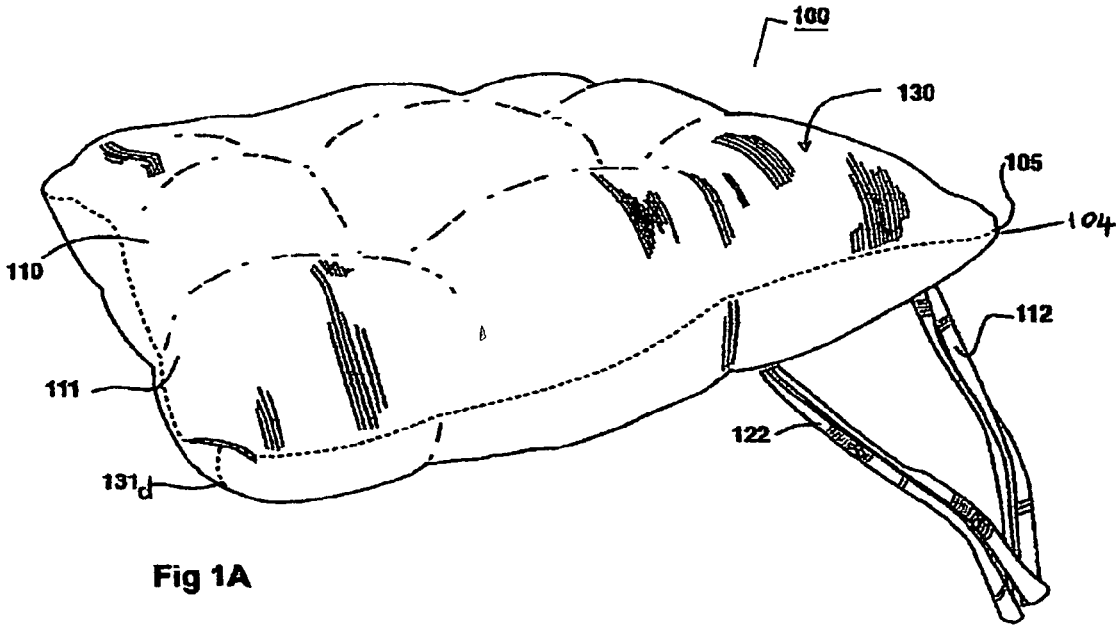
FIG. 1A is a perspective view of an exemplary pad displaying one appearance showing a first fabric thereof according to one embodiment of the present invention.
Figure 1B:
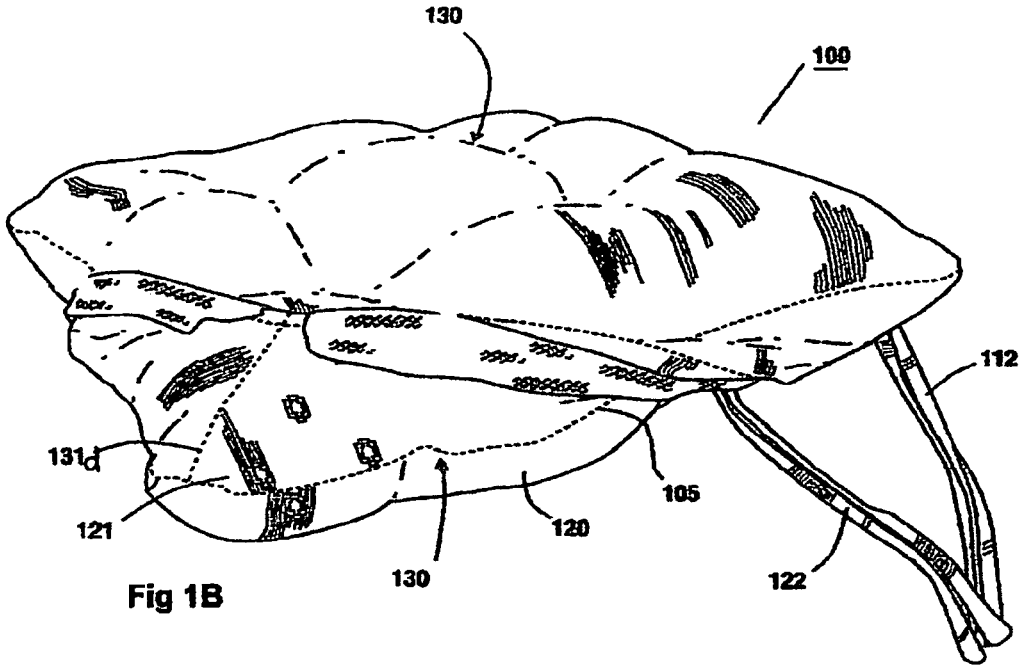
FIG. 1B is a perspective of the exemplary pad displaying a partially reversed appearance where a second fabric is revealed according to the same embodiment of the present invention.
Figure 2A:
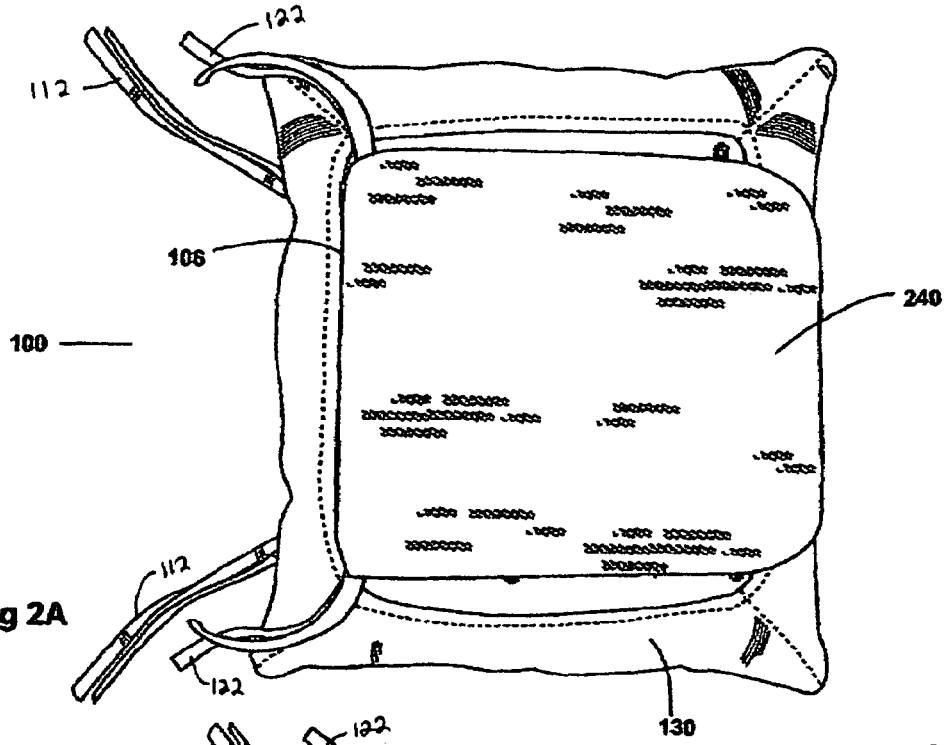
FIG. 2A is a plan view an exemplary pad according to the same embodiment of the present invention.
Figure 2B:
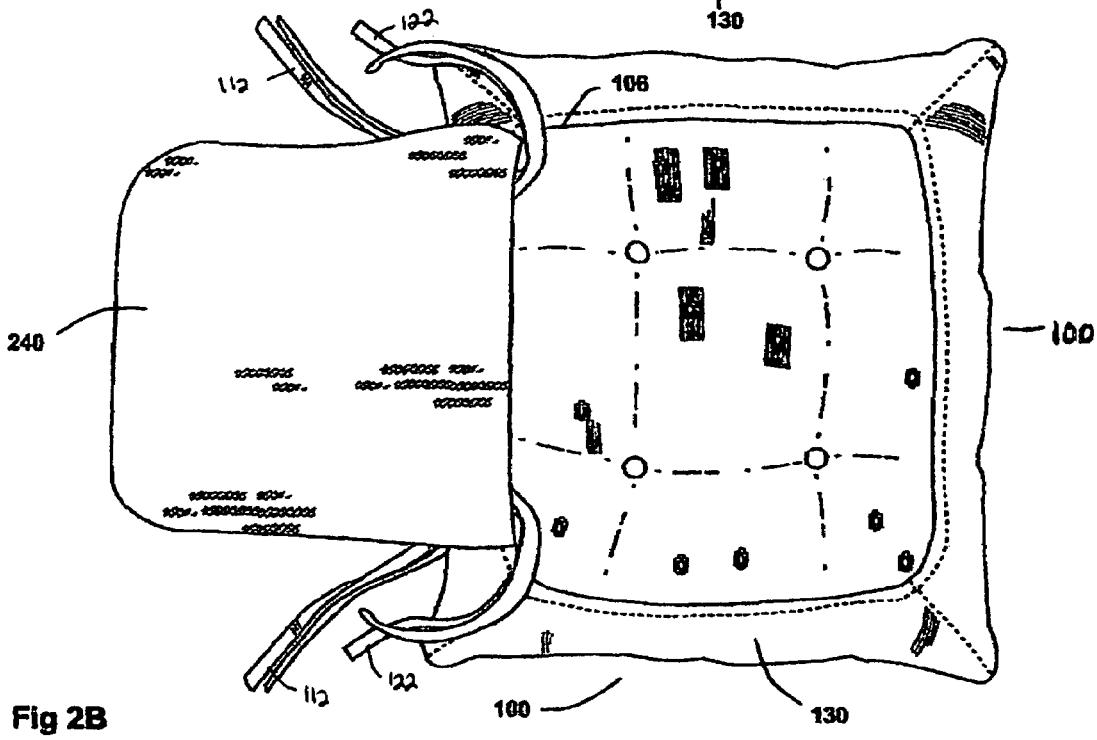
FIG. 2B is a plan view of the exemplary pad of FIG. 2A according the same embodiment of the present invention.

The various embodiments of the present invention and their advantages are best understood by referring to FIGS. 1 through 2B of the drawings. The elements of the drawings are not necessarily to scale, emphasis instead being placed upon clearly illustrating the principles of the invention. Throughout the drawings, like numerals are used for like and corresponding parts of the various drawings. It should be noted that in the drawings, the dotted lines represent seams created by stitching.

The present invention represents an improvement over De Geus, specifically, and includes advantages over the rest of the art in general. With reference to FIGS. 1A and 1B, exemplary pad 100 comprises a pillow member which is covered in a first fabric 111 forming a first surface 110. Likewise the opposing side of pad 100 is covered in a second fabric 121 forming a second surface 120. First and second fabrics 111, 121 are stitched together at the pad perimeter 104 to form a perimeter seam 105 and are dimensioned so as to not only cover pad to perimeter seam 105, but also so that material of each of first and second fabric 111, 121 extends from perimeter seam 105. The pillow member may be a unitary member formed from any suitable material known in the art, a non-limiting example of which is polymeric foam, and which may itself be covered with an additional protective casing (not shown) as would be appreciated by those skilled in the relevant art. The pillow member may alternatively be a casing filled with suitable loose-fill, fibrous or feather material. First and second fabrics 111, 121 thus mutually attached form a two-sided pad cover 130. Pad cover 130 may be attached to insert (not shown).

Peripheral edges of first and second fabrics 111,121 extending outward with respect to pad 100 are sewn together to form a two-ply skirt member 130, the peripheral edges of which comprise skirt perimeter 106. Skirt perimeter 106 is reduced in length compared to pad perimeter 104. This may be done by reducing the area of the skirt by, for example, collapsing angular sections of skirt member 130, the vertices of which rest on pad perimeter. The collapsed section(s) may be closed by stitching, shown in the Figures as comer seams 131*a-d*.

Thus, skirt member 130 partially encloses pad 100 such that when pad is displayed showing only first fabric 111, second fabric 121 is folded back upon itself underneath and second fabric 121 is hidden from view. To invert the cushion to display second fabric 121, pillow member is inserted through an aperture defined by skirt perimeter 106, and skirt member 130 is inverted, resulting in first fabric 111 being folded back upon itself, and first fabric being hidden from view.

Pad 100 further comprises first and second sets of ties 112,122 attached to one edge of perimeter seam 105, first set, made up of one or more strips of fabric, 112 being attached on or proximal to perimeter seam on the side of pad covered by first fabric 111, and second set 122 being likewise attached on the side of pad covered by second fabric 121. A set of ties 112 may be used to secure, in a decorative yet functional manner, pad 100 to a chair, where the chair has at least two back spindles about which ties are knotted. Fabrics from which first and second sets of ties 112, 122 may be the same as first and second fabrics 111, 121 respectively. Optionally, fabrics making up ties may be different from, and yet visually harmonize with, first and second fabrics 111, 121. When either first or second fabric 111, 121 is being displayed, the opposing tie set 122, 112 respectively, may be tucked inside the space formed by the under-folded skirt member 130.

Advantageously pad 100 may include anti-slip means 140 attached to skirt member 130 at skirt perimeter 106. Anti-slip material is a mesh material, often formed of, or coated with, a soft polymeric such as foam polyvinyl chloride that is possessed of a high coefficient of friction and yet does not mar, or permanently adhere to, generally or substantially smooth surfaces, such as wood as used in dining room furniture. It is flexible so that it can be conformed to a variety of shapes and contours, and resilient to survive compression and stretching. Also, the material is very durable and resists degradation over time or over the application of compression by people sitting on the seat and the like. Non-limiting examples of such material include the following commercially available products: "MAGIC GRIP™" by American Non-Slip Products, a division of Capital USA, LLC, and located in Alpharetta, Ga.; "EASY LINER®" by Henkel Consumer Adhesives, Inc., located in Avon, Ohio, Gulph Mills, Pa., and Scottsdale, Ariz.; and "SLITP-STOP" offered by Camco Manufacturing, Inc. of Greensboro, N.C.

An exemplary embodiment incorporating anti-slip means is described with reference to FIG. 2, which displays possible anti-slip means attached to the skirt perimeter. Pad 100 includes the features described above and further includes anti-slip means 240 which comprises a sheet of anti-slip material as described above. Anti-slip sheet 240 is dimensioned to comprise less area that the plan form area of pad 100 so as to be hidden from view when pad is placed upon a chair, and is attached to pad by stitching and/or gluing one edge of the sheet to the edge of skirt perimeter 106. Anti-slip sheet 240 may be attached to pad 100 during the step for forming the skin member 130 by inserting one sheet edge between first and second fabrics 111, 121 and stitching all three layers together when the skirt perimeter is formed. Anti-slip sheet 240 is thus positioned to be employed on either side of pad independent of which fabric is displayed by placing pad 100 upon a chair so that anti-slip sheet 240 is between the bottom of the pad and the chair seat surface. It will be recognized that anti-slip sheet 240 may be attached to any edge of skirt perimeter.

I claim:

1. A reversible chair pad having a cover comprising first and second fabrics forming respective first and second surfaces of said pad and mutually attached at the pad perimeter, and where said first and second fabrics also form a two-ply skirt member extending from the pad perimeter, said skirt member having a skirt perimeter that is less than the length of the pad perimeter and disposed to one side of said pad such that said pad displays only one of said first or second fabrics, and further comprising:

a. a first set of securing ties for securing said pad to chair spindles when said pad is configured to display said first fabric, said first set of ties attached to an edge of a perimeter seam intermediate said skirt member and said first surface; and b. a second set of securing ties for securing said pad to chair spindles when said pad is configured to display said second fabric, said second set of ties attached to said edge of said perimeter seam intermediate said skirt member and said second surface.

2. The reversible chair pad of claim 1, further comprising anti-slip means secured to said skirt perimeter such that said anti-slip means is operable to contact a chair seat surface independent of pad display.

3. The reversible chair pad of claim 2, wherein said anti-slip means is anti-slip material folded about said skirt perimeter such that generally equal portions of said material are disposed upon said first and second fabrics comprising said skirt member.

4. The reversible chair pad of claim 3, wherein said first and second sets of ties are comprised of first and second fabrics respectively.

5. The reversible chair pad of claim 3, wherein said anti-slip material is three pieces of anti-slip material secured to said skirt perimeter.

6. The reversible chair pad of claim 5, wherein said first and second sets of ties are comprised of first and second fabrics respectively.

7. The reversible chair pad of claim 2, wherein said anti-slip means is a sheet of anti-slip material dimensioned to be smaller in area than a plan form area of said pad and attached by one edge of said sheet to an edge of said skirt perimeter corresponding to an edge of said pad perimeter.

8. The reversible chair pad of claim 7, wherein said first and second sets of ties are comprised of first and second fabrics respectively.

9. A casing for a reversible chair pad having first and second fabrics forming respective first and second surfaces of said pad and mutually attached at the pad perimeter, and where said first and second fabrics also form a two-ply skirt member extending from the pad perimeter, said skirt member having a skirt perimeter that is less than the length of the pad perimeter and disposed to one side of said pad such that said pad displays only one of said first or second fabrics, and further comprising:

a. a first set of securing ties for securing said pad to chair spindles when said pad is configured to display said first fabric, said first set of ties attached to an edge of a perimeter seam intermediate said skirt member and said first surface; and b. a second set of securing ties for securing said pad to chair spindles when said pad is configured to display said second fabric, said second set of ties attached to said edge of said perimeter seam intermediate said skirt member and said second surface.

10. The casing for a reversible chair pad as in claim 9, further comprising anti-slip means secured to said skirt perimeter such that said anti-slip means is operable to contact a chair seat surface independent of pad display.

11. The casing for a reversible chair pad as in claim 10, wherein said anti-slip means is anti-slip material folded about said skirt perimeter, such that generally equal portions of said material are disposed upon said first and second fabrics comprising said skirt member.

12. The casing for a reversible chair pad as in claim 11, wherein said first and second sets of ties are comprised of first and second fabrics respectively.

13. The casing for a reversible chair pad as in claim 11, wherein said anti-slip material is three pieces of anti-slip material secured to said skirt perimeter.

14. The casing for a reversible chair pad as in claim 13, wherein said first and second sets of ties are comprised of first and second fabrics respectively.

15. The casing for a reversible chair pad as in claim 10 wherein said anti-slip means is a sheet of anti-slip material dimensioned to be smaller in area than a plan form area of said pad and attached by one edge of said sheet to an edge of said skirt perimeter corresponding to an edge of said pad perimeter.

16. The casing for a reversible chair pad as in claim 15, wherein said first and second sets of ties are comprised of first and second fabrics respectively.

* * * * *